US007556447B2

(12) United States Patent
Bruggeman et al.

(10) Patent No.: US 7,556,447 B2
(45) Date of Patent: Jul. 7, 2009

(54) METERED TWIST PAINT STICK

(75) Inventors: Daniel J. Bruggeman, Minneapolis, MN (US); Stephen C. Kohs, Forest Lake, MN (US); Dion M. McDevitt, Ramsey, MN (US); Dallas Simonette, Las Vegas, NV (US)

(73) Assignee: Diversified Dynamics Corporation, Minneapolis, MN (US)

( * ) Notice: Subject to any disclaimer, the term of this patent is extended or adjusted under 35 U.S.C. 154(b) by 377 days.

(21) Appl. No.: 11/188,337

(22) Filed: Jul. 25, 2005

(65) Prior Publication Data

US 2007/0020035 A1 Jan. 25, 2007

(51) Int. Cl.
*B05C 1/00* (2006.01)

(52) U.S. Cl. ..... 401/197; 401/173; 401/176; 401/182

(58) Field of Classification Search ..... 401/197, 401/205, 173, 174, 176, 179, 182, 277; 222/390, 222/174

See application file for complete search history.

(56) References Cited

U.S. PATENT DOCUMENTS

| | | | |
|---|---|---|---|
| 615,751 | A | 12/1898 | Sands |
| 1,186,088 | A | 6/1916 | Finlay |
| 1,268,271 | A | 6/1918 | Nelson |
| 1,428,079 | A | 9/1922 | Clark |
| 1,691,024 | A | 11/1928 | Gedge |
| 1,714,350 | A | 5/1929 | De Jong |
| 1,875,574 | A | 9/1932 | Duncan |
| 2,011,635 | A | 8/1935 | Homan |
| 2,082,582 | A | 6/1937 | Kling |
| 2,249,401 | A | 7/1941 | Sieg |
| 2,281,367 | A | 4/1942 | Moll |
| 2,301,586 | A | 11/1942 | Rubin |
| 2,350,469 | A | 6/1944 | Litka |

(Continued)

FOREIGN PATENT DOCUMENTS

| | | |
|---|---|---|
| AU | 129491 | 2/1947 |

(Continued)

OTHER PUBLICATIONS

Homeright Instructional Packet, "Electric Power-Flo Roller Instructions," (12 pgs.).

(Continued)

*Primary Examiner*—David J Walczak
(74) *Attorney, Agent, or Firm*—Gerald E. Helget; Nelson R. Capes; Briggs and Morgan, P.A.

(57) ABSTRACT

An apparatus for painting a surface, having an absorbent paint applicator containing paint and contacting the surface; a tube filled with paint and connected to the applicator; and a metering device for incrementally metering paint onto the applicator from the tube. The metering device has a plunger reciprocating within the tube, with the plunger having a handle. The plunger can either be incrementally advanced within the tube by rotating the handle, thereby incrementally dispensing paint onto the applicator, or the plunger can be manually retracted within the tube to fill the tube with paint and manually advanced within the tube to dispense the paint. The plunger is helically grooved along its length and a converter translates rotation of the handle into linear motion of the plunger, thereby advancing the plunger within the tube.

6 Claims, 11 Drawing Sheets

U.S. PATENT DOCUMENTS

| | | | |
|---|---|---|---|
| 2,443,981 | A | 6/1948 | Funk et al. |
| 2,517,551 | A | 8/1950 | Eckman |
| 2,521,967 | A | 9/1950 | Dean |
| 2,557,214 | A | 6/1951 | Bales |
| 2,564,721 | A | 8/1951 | Raya |
| 2,576,192 | A | 11/1951 | Poznik |
| 2,613,384 | A | 10/1952 | Collins |
| 2,632,904 | A | 3/1953 | Halecky |
| 2,647,273 | A | 8/1953 | Eagle |
| 2,682,071 | A | 6/1954 | Linderoth |
| 2,685,702 | A | 8/1954 | Jones |
| 2,722,029 | A | 11/1955 | Barnes et al. |
| 2,727,268 | A | 12/1955 | Hucke |
| 2,805,646 | A | 9/1957 | Shlesinger, Jr. |
| 2,825,916 | A | 3/1958 | Basala, Jr. |
| 2,856,622 | A | 10/1958 | Jacobsen |
| 2,916,755 | A | 12/1959 | De Bozzay |
| 2,964,769 | A | 12/1960 | Mercereau |
| 2,997,732 | A | 8/1961 | Gilchrist et al. |
| 3,000,040 | A | 9/1961 | Carlson |
| 3,020,579 | A | 2/1962 | O'Connor |
| 3,103,690 | A | 9/1963 | Day |
| 3,114,922 | A | 12/1963 | Ballantyne |
| 3,148,401 | A | 9/1964 | Gilchrist et al. |
| 3,166,775 | A | 1/1965 | Cushman |
| 3,170,182 | A | 2/1965 | Burian |
| 3,175,242 | A | 3/1965 | Kamondy et al. |
| 3,195,170 | A | 7/1965 | Howard |
| 3,210,794 | A | 10/1965 | Vosbikian |
| 3,231,151 | A | 1/1966 | Clark et al. |
| 3,337,899 | A | 8/1967 | Rentfrow |
| 3,369,268 | A | 2/1968 | Burns et al. |
| 3,372,976 | A | 3/1968 | MacFarland |
| 3,418,054 | A | 12/1968 | Kirch |
| 3,422,844 | A | 1/1969 | Grise |
| 3,455,638 | A | 7/1969 | Braswell |
| 3,457,017 | A | 7/1969 | Bastian |
| 3,459,482 | A | 8/1969 | Fears |
| 3,476,507 | A | 11/1969 | Leeds |
| 3,504,699 | A | 4/1970 | Grisé |
| 3,554,659 | A | 1/1971 | Stokes |
| 3,612,707 | A | 10/1971 | Herbrechter |
| 3,623,179 | A | 11/1971 | Roth |
| 3,702,739 | A | 11/1972 | Rentfrow |
| 3,713,744 | A | 1/1973 | Sims |
| 3,734,149 | A | 5/1973 | Hansel |
| 3,766,879 | A | 10/1973 | Jones |
| 3,774,252 | A | 11/1973 | Cantales |
| 3,776,645 | A | 12/1973 | Walker |
| 3,783,469 | A | 1/1974 | Siemund |
| 3,822,720 | A | 7/1974 | Souza |
| 3,837,381 | A | 9/1974 | Arroyo |
| 3,837,747 | A | 9/1974 | Seymore |
| 3,850,408 | A | 11/1974 | Shelnick |
| 4,032,239 | A | 6/1977 | Maupin |
| 4,066,366 | A | 1/1978 | Reynolds |
| 4,067,414 | A | 1/1978 | Funke |
| 4,119,386 | A | 10/1978 | Cushing |
| 4,217,062 | A | 8/1980 | Trp et al. |
| 4,231,668 | A | 11/1980 | Groth et al. |
| 4,269,331 | A * | 5/1981 | Watson ..... 222/390 |
| 4,291,491 | A | 9/1981 | Maddock |
| 4,312,093 | A | 1/1982 | Raab |
| 4,315,342 | A | 2/1982 | Ash |
| 4,324,018 | A | 4/1982 | Olsson |
| 4,357,779 | A | 11/1982 | Maddock |
| 4,434,810 | A | 3/1984 | Atkinson |
| 4,436,519 | A | 3/1984 | O'Neill |
| 4,475,262 | A | 10/1984 | Downer |
| 4,540,301 | A | 9/1985 | Swanson et al. |
| 4,611,941 | A | 9/1986 | Karliner et al. |
| 4,639,156 | A | 1/1987 | Stern et al. |
| 4,695,176 | A | 9/1987 | Simonette et al. |
| 4,732,503 | A | 3/1988 | Bader et al. |
| 4,810,123 | A | 3/1989 | Bruggeman |
| 4,822,194 | A | 4/1989 | Simonette |
| 4,852,210 | A | 8/1989 | Krajicek |
| 4,944,623 | A | 7/1990 | McNeil |
| 4,971,471 | A | 11/1990 | Sloan |
| 4,997,302 | A | 3/1991 | Simonette |
| 5,020,181 | A | 6/1991 | Leonard |
| 5,167,055 | A | 12/1992 | Stoddart et al. |
| 5,272,782 | A | 12/1993 | Hutt |
| 5,425,589 | A | 6/1995 | Griffin et al. |
| 5,594,971 | A | 1/1997 | Nelson |
| 5,613,264 | A | 3/1997 | Knowles |
| 6,109,811 | A | 8/2000 | Song |
| 6,142,693 | A | 11/2000 | Bruggeman et al. |
| 6,244,771 | B1 | 6/2001 | Bruggeman et al. |
| D444,928 | S | 7/2001 | Bruggeman et al. |
| 6,474,891 | B1 * | 11/2002 | Liu ..... 401/174 |
| D476,122 | S | 6/2003 | Bruggeman et al. |
| 6,726,389 | B1 | 4/2004 | Lee |
| 2001/0025394 | A1 | 10/2001 | Napolitan |

FOREIGN PATENT DOCUMENTS

| | | |
|---|---|---|
| CA | 784908 | 5/1968 |
| EP | 0572236 | 1/1998 |
| FR | 2 596 675 | 10/1987 |
| GB | 735590 | 8/1955 |
| GB | 868894 | 5/1961 |
| GB | 2094443 | 9/1982 |
| GB | 2148154 | 5/1985 |
| GB | 2155147 | 9/1985 |
| WO | WO 02/28547 A1 | 4/2002 |

OTHER PUBLICATIONS

Wagner Instructional Packet, "The Right Tool for the Right Job," 2001 Wagner Spray Tech., (16 pgs.).

* cited by examiner

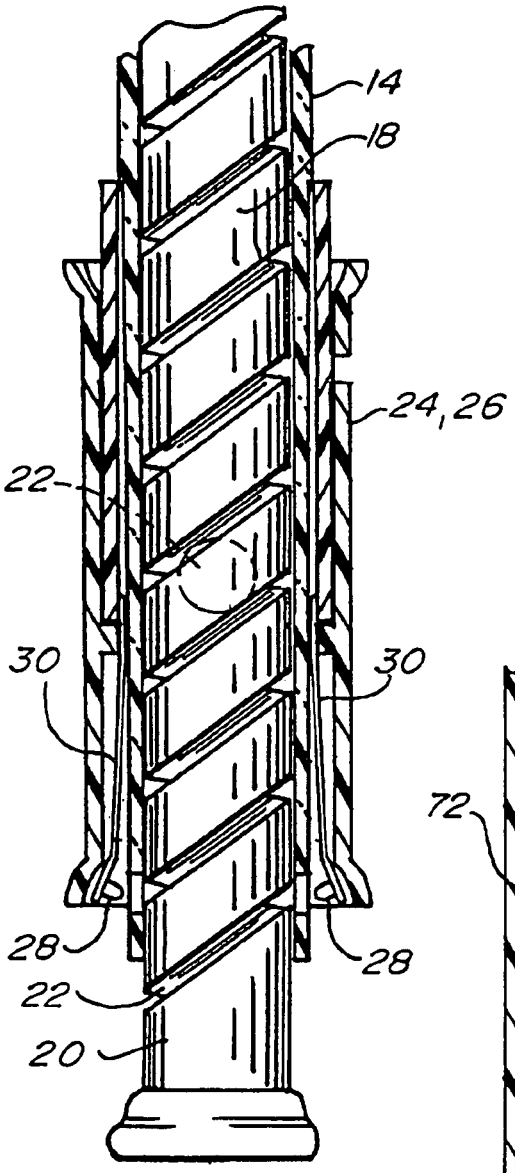
Fig.16.
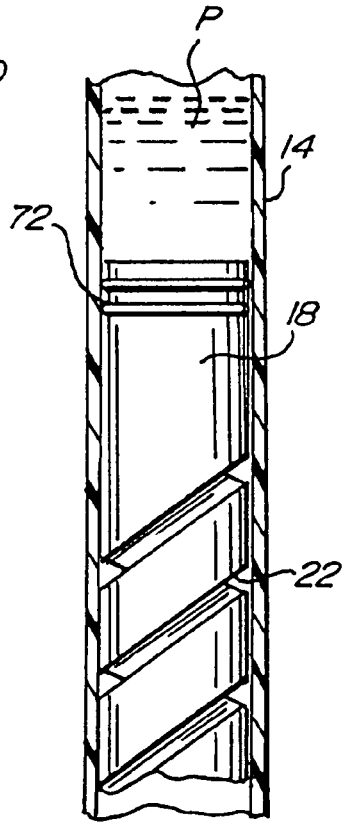
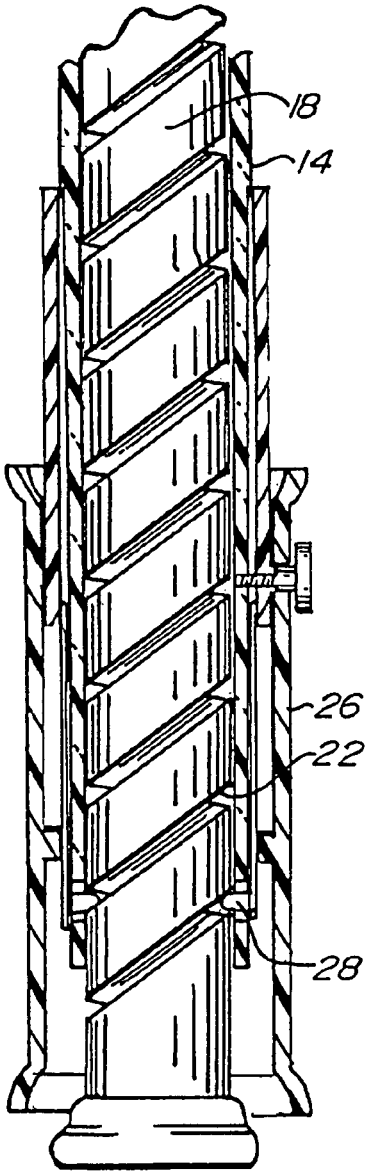
Fig.17.
Fig.18.

METERED TWIST PAINT STICK

BACKGROUND OF THE INVENTION

The present invention relates to a device for dispensing paint onto a pad or roller and particularly to a device that can dispense paint to the pad or roller either incrementally or in larger amounts.

Paint sticks are generally known in the art and comprise elongate painting tools generally having a tube that is filled with paint from a can. One end of the tube is connected to a painting pad or roller. Paint is dispensed from the tube onto the pad or roller either by pushing a plunger into the tube or by squeezing a trigger. One example is the Paintmate Plue® tool from Wagner Spray Tech, Inc.

A problem with such paint sticks is that it is difficult for the user to dispense small amounts of paint incrementally. For example, if the plunger is pushed, the user has little control over the amount of paint that will be applied to the pad or roller. This can caused paint to drip from the pad or roller onto the user or the environment. In the case of a paint stick with a trigger mechanism, it may still be difficult for the user to exert fine control over the paint dispenser and, in addition, repeated use of the trigger (generally by squeezing a handle) can cause discomfort to the hands and perhaps lead to carpal tunnel syndrome.

There is a need for a paint dispensing apparatus that addresses the above problems.

SUMMARY OF THE INVENTION

Apparatus for painting a surface, comprising:

an absorbent paint applicator containing paint and adapted to contact the surface;

a tube filled with paint, the tube connected to the applicator; and a metering device for incrementally metering paint onto the applicator from the tube;

wherein the metering device further comprises a plunger reciprocating within the tube, the plunger having a handle, the plunger being incrementally advanced within the tube by rotating the handle, thereby dispensing paint onto the applicator.

A principle object and advantage of the present invention is that it allows the user to dispense small amounts of paint incrementally.

Another principle object and advantage of the present invention is that it give the user greater control over the amount of paint that will be applied to the pad or roller.

Another principle object and advantage of the present invention is that it prevents excess paint from dripping from the pad or roller onto the user or into the environment.

Another principle object and advantage of the present invention is that it prevents discomfort and damage to the user's hands that can be caused by squeezing a trigger.

BRIEF DESCRIPTION OF THE DRAWINGS

FIG. 16 is a cross-section at approximately along the lines 16 of FIG. 12.

FIG. 17 is a cross-section approximately along the lines 17 of FIG. 14.

FIG. 18 is a cross-section of the dispensing end of the present invention.

DETAILED DESCRIPTION OF THE PREFERRED EMBODIMENT

Figure 1:
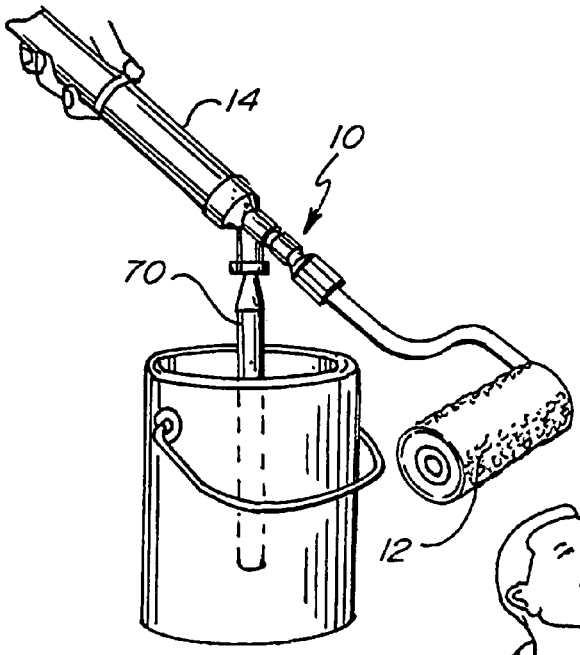
FIG. 1 is a perspective view showing t he present invention being filled from a can of paint.
Figure 2:
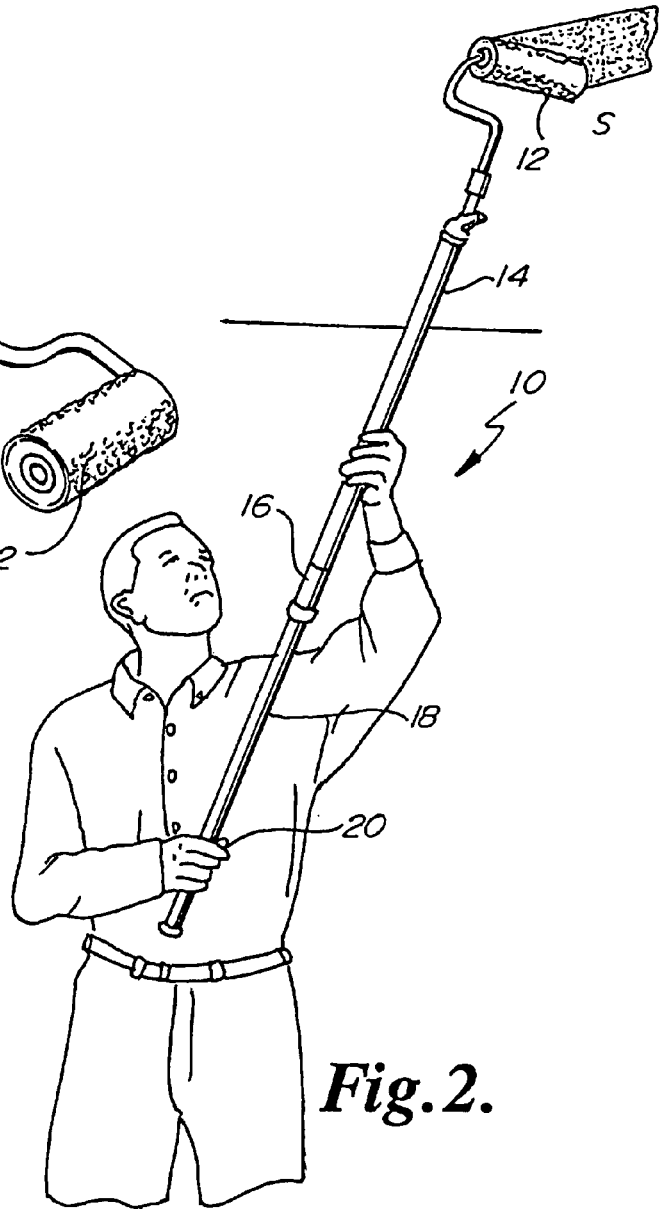
FIG. 2 is a perspective view of a user employing the present invention to paint a ceiling.
Figure 3:
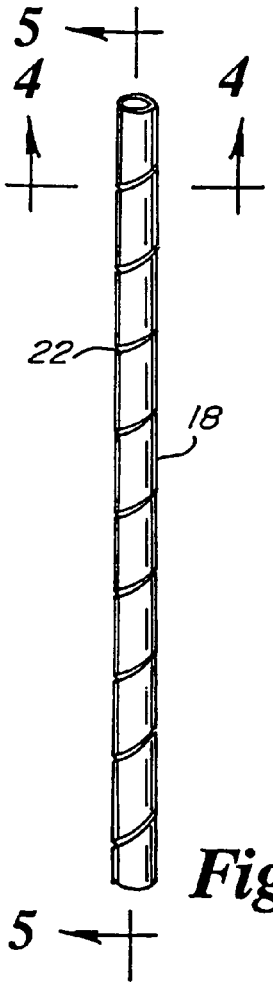
FIG. 3 is a perspective view of a first embodiment of a plunger of the present invention, having a single helical groove.
Figure 4:
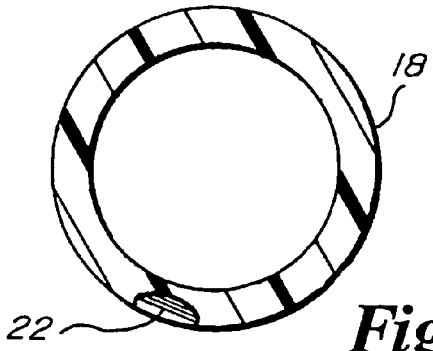
FIG. 4 is a cross-section approximately along the lines 4 of FIG. 3.
Figure 5:
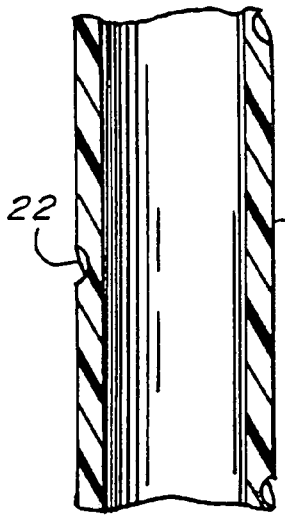
FIG. 5 is a cross-section approximately along the lines 5 of FIG. 3.

The apparatus of the present invention is generally shown in the Figures as reference numeral 10.

In one aspect, the present invention 10 is an apparatus for painting a surface S, comprising an absorbent paint applicator 12 containing paint P and adapted to contact the surface S; a tube 14 filled with paint P, the tube 14 connected to the applicator 12; and a metering device 16 for incrementally metering paint P onto the applicator 12 from the tube 14; wherein the metering device 16 further comprises a plunger 18 reciprocating within the tube 14, the plunger 18 having a handle 20, the plunger 18 being incrementally advanced within the tube 14 by rotating the handle 20, thereby dispensing paint P onto the applicator 12.

In one embodiment (FIGS. 3-5, 16), the plunger 18 is helically grooved along its length with a single helical groove 22. In this embodiment, the apparatus 10 further comprises a converter 24 translating rotation of the handle 20 into linear motion of the plunger 18, thereby advancing the plunger 18 within the tube 14.

In this embodiment, the converter 24 further comprises a collar 26 surrounding the tube 14, the collar 26 pressing a pin 28 into the helical groove 22, the helical groove 22 moving along the pin 28 as the handle 20 is rotated.

Figure 12:
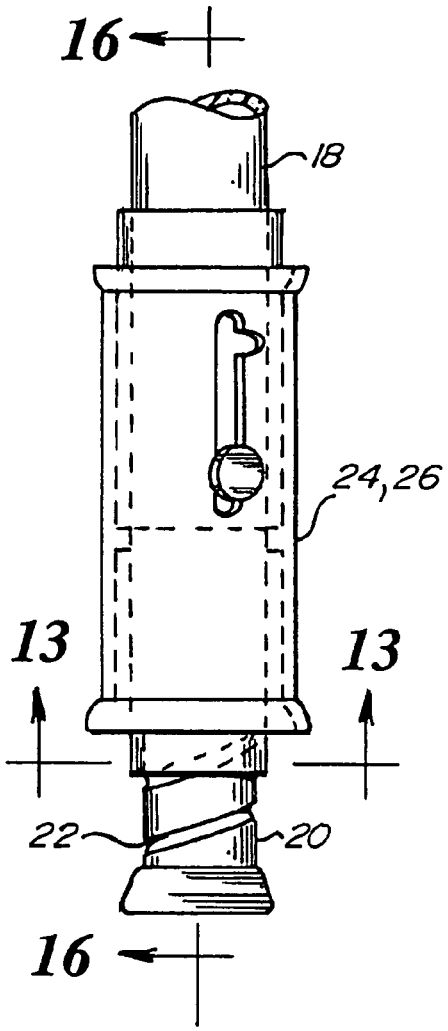
FIG. 12 is a detailed perspective view of one embodiment of the present invention, showing a converter of the present device in a locked position.
Figure 14:
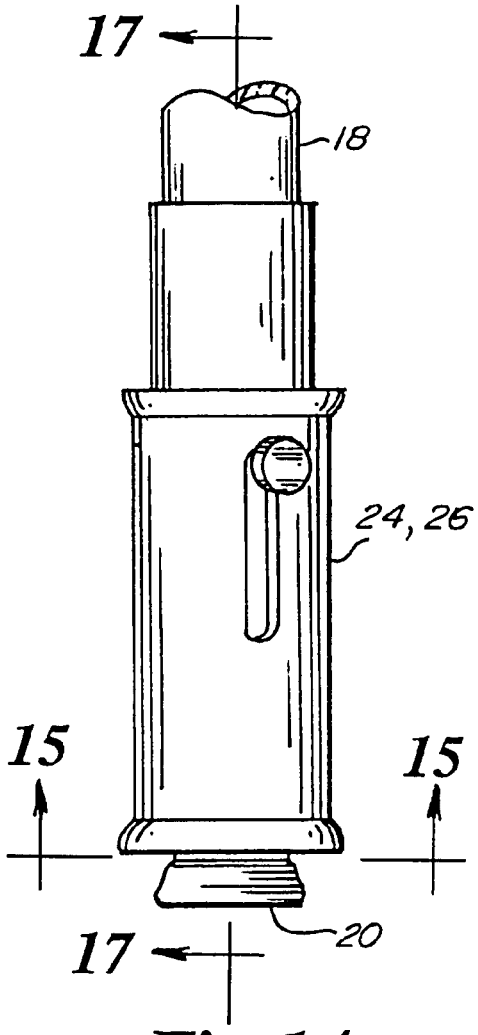
FIG. 14 is similar to FIG. 12, but shows the converter of the present invention in an unlocked position.
Figure 13:
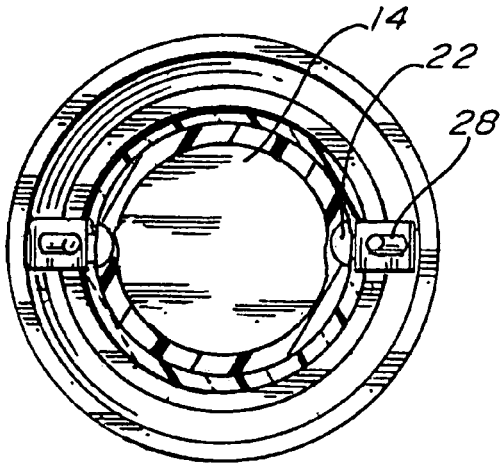
FIG. 13 is a cross-section approximately along the lines 13 of FIG. 12.
Figure 15:
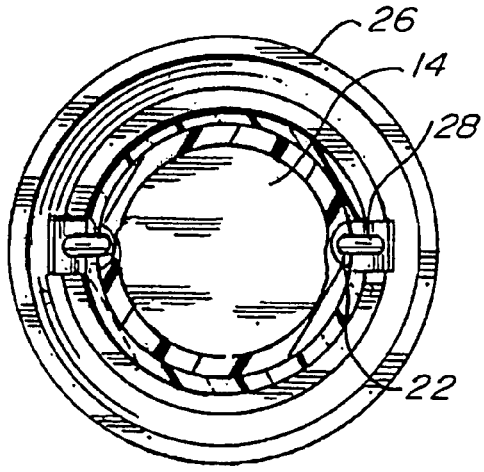
FIG. 15 is a cross-section at approximately along the lines 15 of FIG. 14.

Preferably, the pin 28 is biased away from the helical groove 22 by a spring or spring-like member 30. The collar 26 is movable between a first position (FIGS. 14, 15, 17) in which the collar 26 presses the pin 28 into the groove 22, locking the converter 24 to translate rotation of the handle 20 into linear motion advancing the plunger 18 within the tube 14, and a second position (FIGS. 12, 13, 16) in which the collar 26 releases the pin 28 from the groove 22, thereby allowing the user to manually push the plunger 18 into the tube 14, thus dispensing larger quantities of paint.

Figure 6:
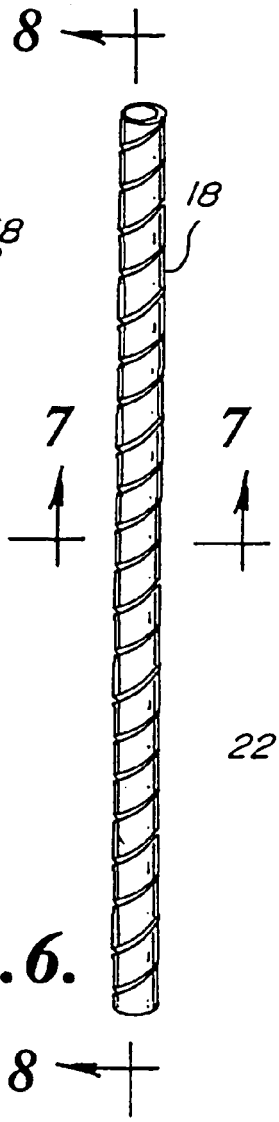
FIG. 6 is similar to FIG. 3, but having two helical grooves.
Figure 7:
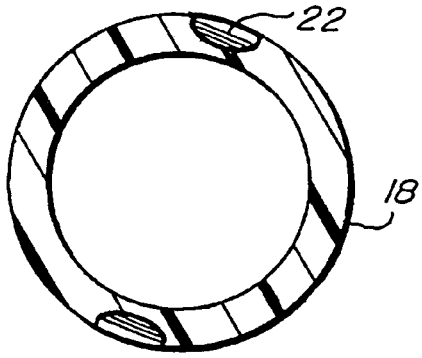
FIG. 7 is a cross-section approximately along the lines 7 of FIG. 6.
Figure 8:
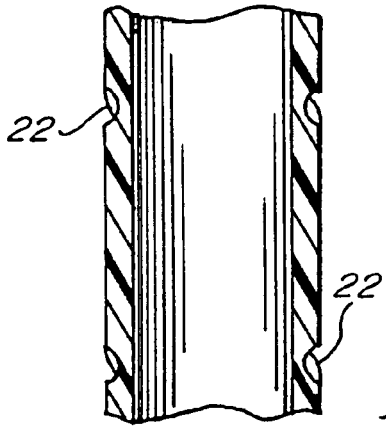
FIG. 8 is a cross-section approximately along the lines 8 of FIG. 6.
Figure 9:
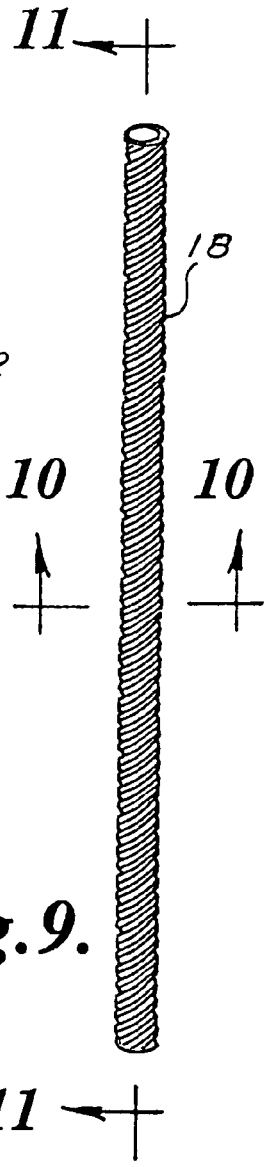
FIG. 9 is similar to FIG. 6, but having multiple helical grooves.
Figure 10:
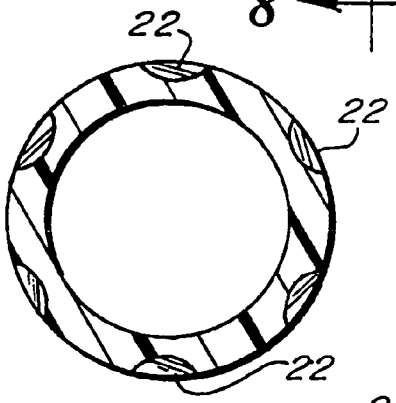
FIG. 10 is a cross-section approximately along the lines 10 of FIG. 9.
Figure 11:
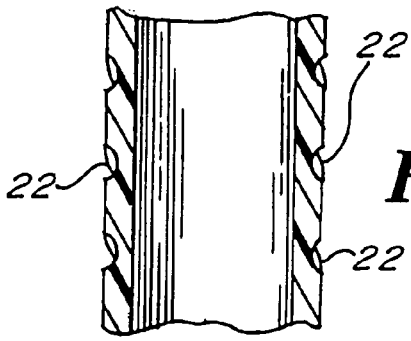
FIG. 11 is a cross-section approximately along the lines 11 of FIG. 9.

Preferably, the apparatus 10 further comprises at least one additional pin 28 pressed into the helical groove 22 by the collar 26. This provides an additional point against which the helical groove 22 may move, increasing the efficiency of the device. The efficiency may be further increased by providing at least one additional helical groove 22 (FIGS. 6-8), and even further by multiple helical grooves 22 (FIGS. 9-11).

Figure 19:
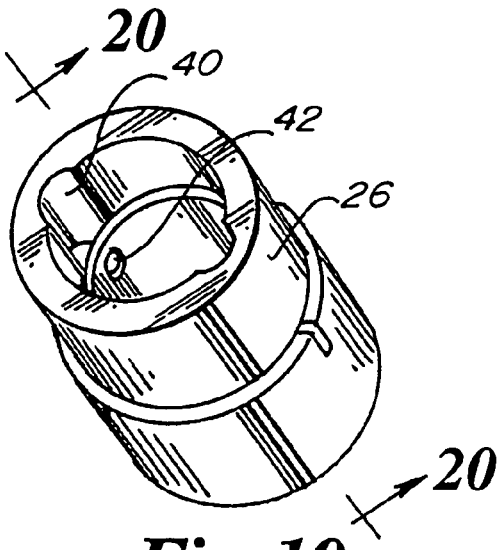
FIG. 19 is a perspective of a second embodiment of the converter of the present invention in the unlocked position.
Figure 20:
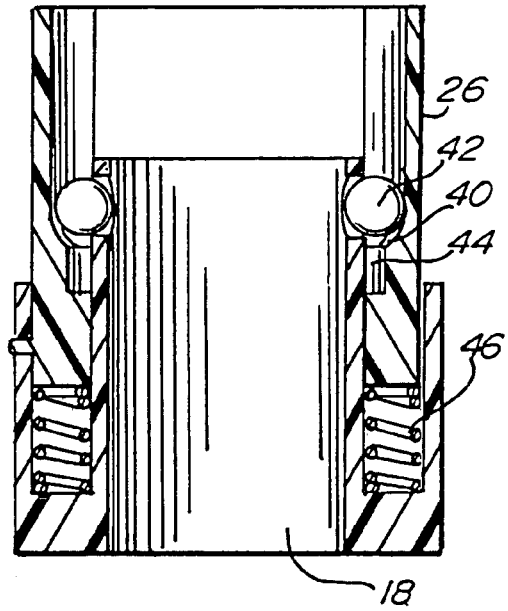
FIG. 20 is a cross-section taken at approximately the lines 20 of FIG. 19.
Figure 21:
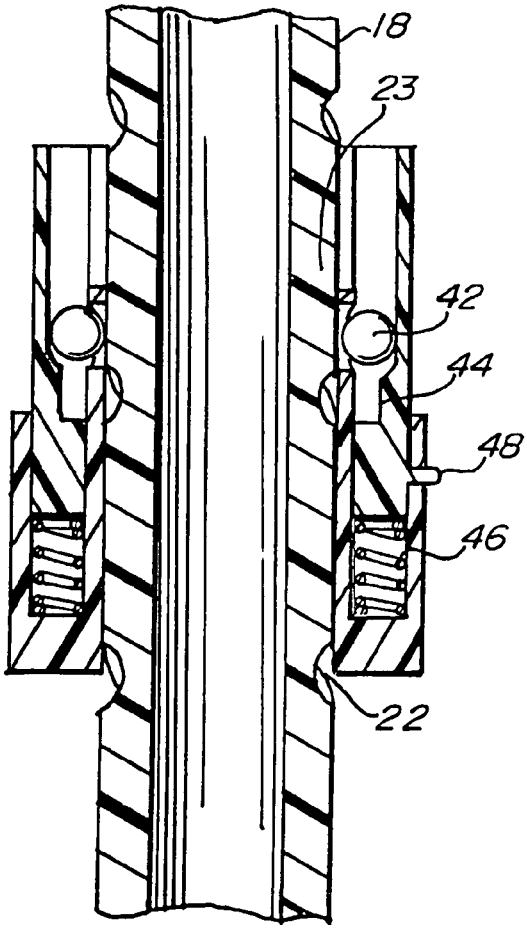
FIG. 21 is similar to FIG. 20, showing the converter in relation to the plunger.
Figure 22:
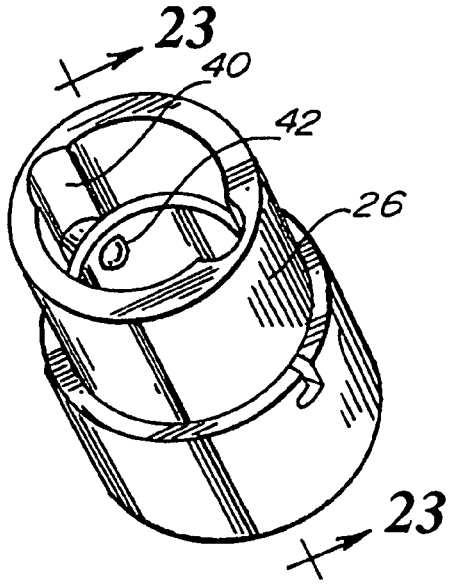
FIG. 22 is similar to FIG. 19, showing the converter in the locked position.
Figure 23:
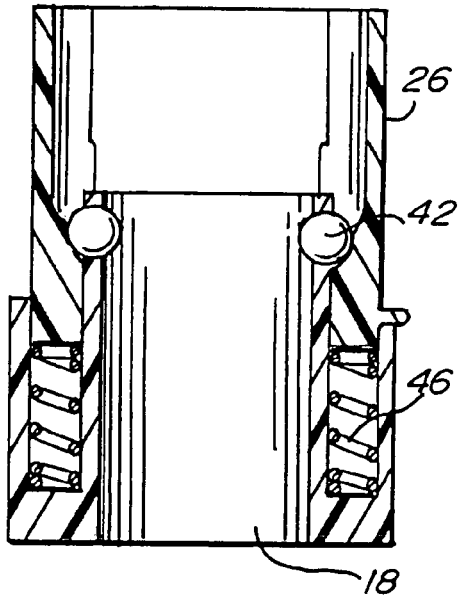
FIG. 23 is a cross-section taken at approximately the lines 23 of FIG. 22.
Figure 24:
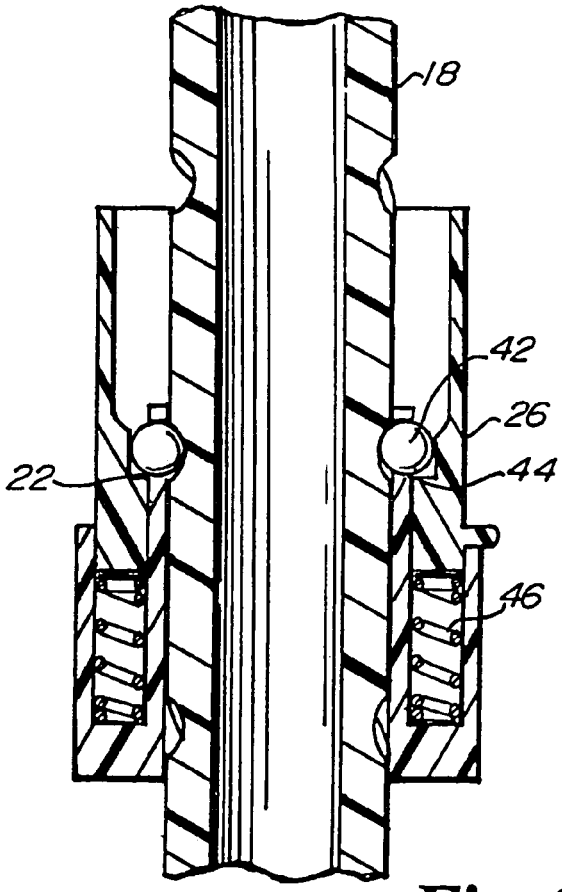
FIG. 24 is similar to FIG. 23, showing the converter in relation to the plunger.

In a second embodiment (FIGS. 19-24), rather than pressing a pin into the helical groove, the converter collar 26 has a bearing race 40 with a bearing 42 within the race., the race 40 having a constricted portion 44 pressing the bearing 42 into the helical groove 22, the helical groove 22 moving along the bearing 42 as the handle is rotated. Preferably, the collar 26 slides along the plunger 18, and a spring 46 biases the collar 26 to a first position (FIGS. 22-24) along the plunger 18 in which the constricted portion 44 forces the bearing 42 into the helical groove 22, locking the converter to translate rotation into linear motion advancing the plunger within the tube, and the collar may be moved to a second position (FIGS. 19-21) against the spring bias with a detent 48 holding the collar 26 at the second position along the plunger in which the bearing 42 is forced out of the helical groove 22 by a non-grooved portion 23 of the plunger, thereby allowing the user to manually push the plunger into the tube.

Figure 25:
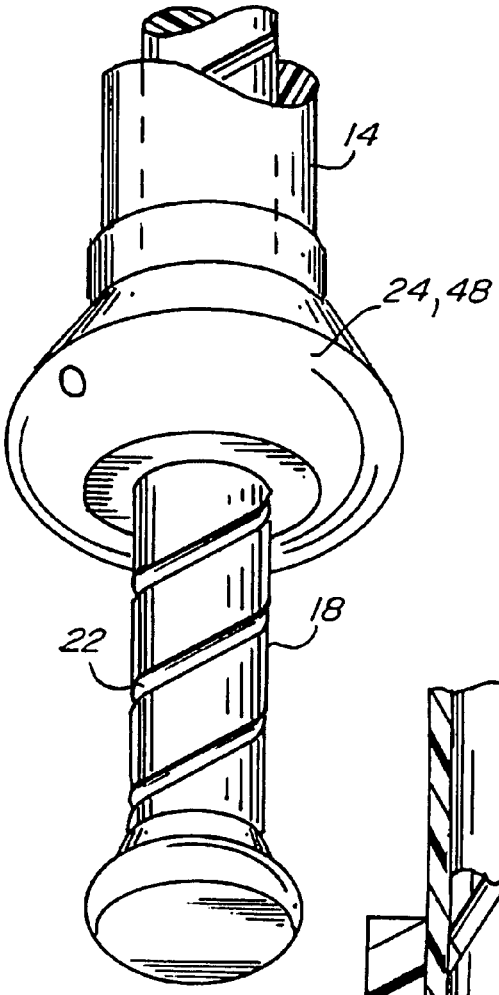
FIG. 25 is a perspective view of a third embodiment of the converter of present invention.
Figure 26:
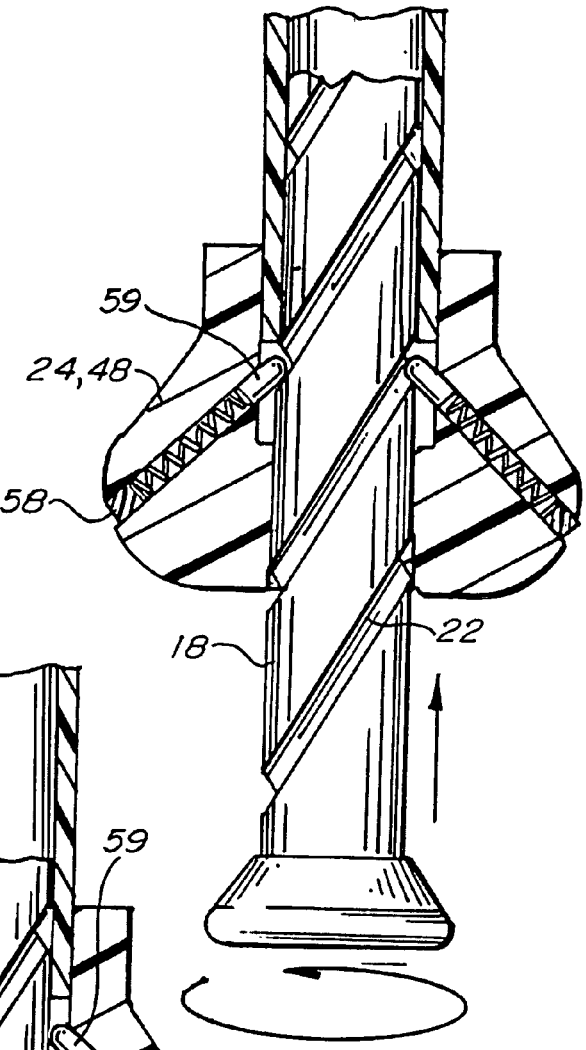
FIG. 26 is a cross-section of the embodiment of FIG. 25, showing the converter in the locked position.
Figure 27:
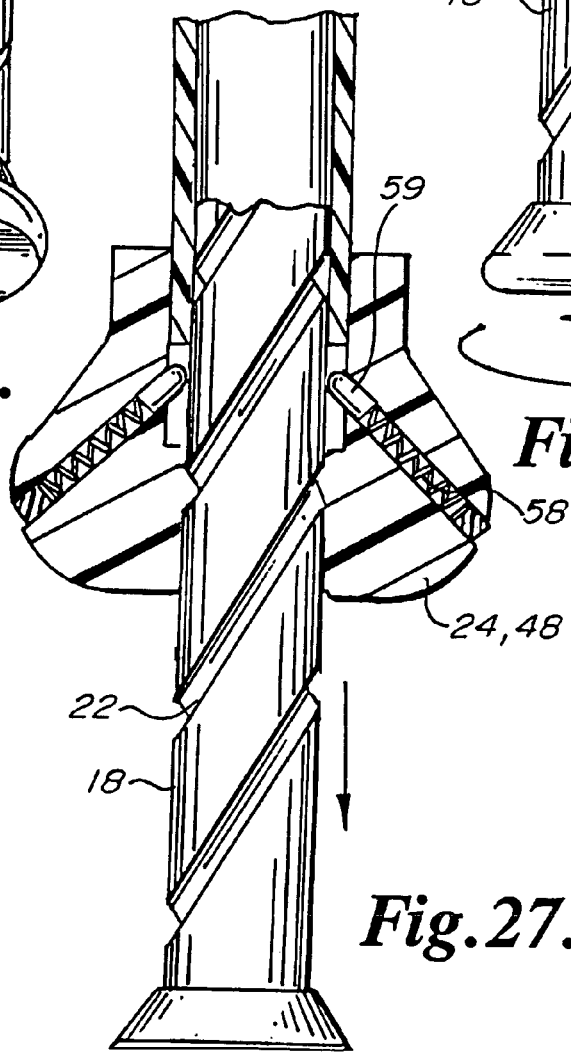
FIG. 27 is similar to FIG. 26, showing the converter in the unlocked position.

In a third embodiment (FIGS. 25-27), the converter 24 comprises a knob 48 is mounted on the tube 14. The knob 48 has a spring 58 biased within the knob toward the helical groove 22. The plunger 18 may be pulled rearwardly (away from the paint applicator) so that the spring 58 rides successively over the various turns of the helical groove 22. When the plunger has been pulled far enough rearwardly to fill the tube 14 with paint, the spring 58 will be contacting the helical groove 22. FIGS. 26 shows the converter 24 in the locked position, with the spring 58 contacting the helical groove 22. FIGS. 27 shows the converter 24 in the unlocked position, in which the plunger 18 has been pulled toward the user, thus causing the springs 58 to leave the helical groove 22, unlocking the converter. The spring 58 may have a cap 59 contacting the helical groove, and there may be more than one spring.

Figure 28:
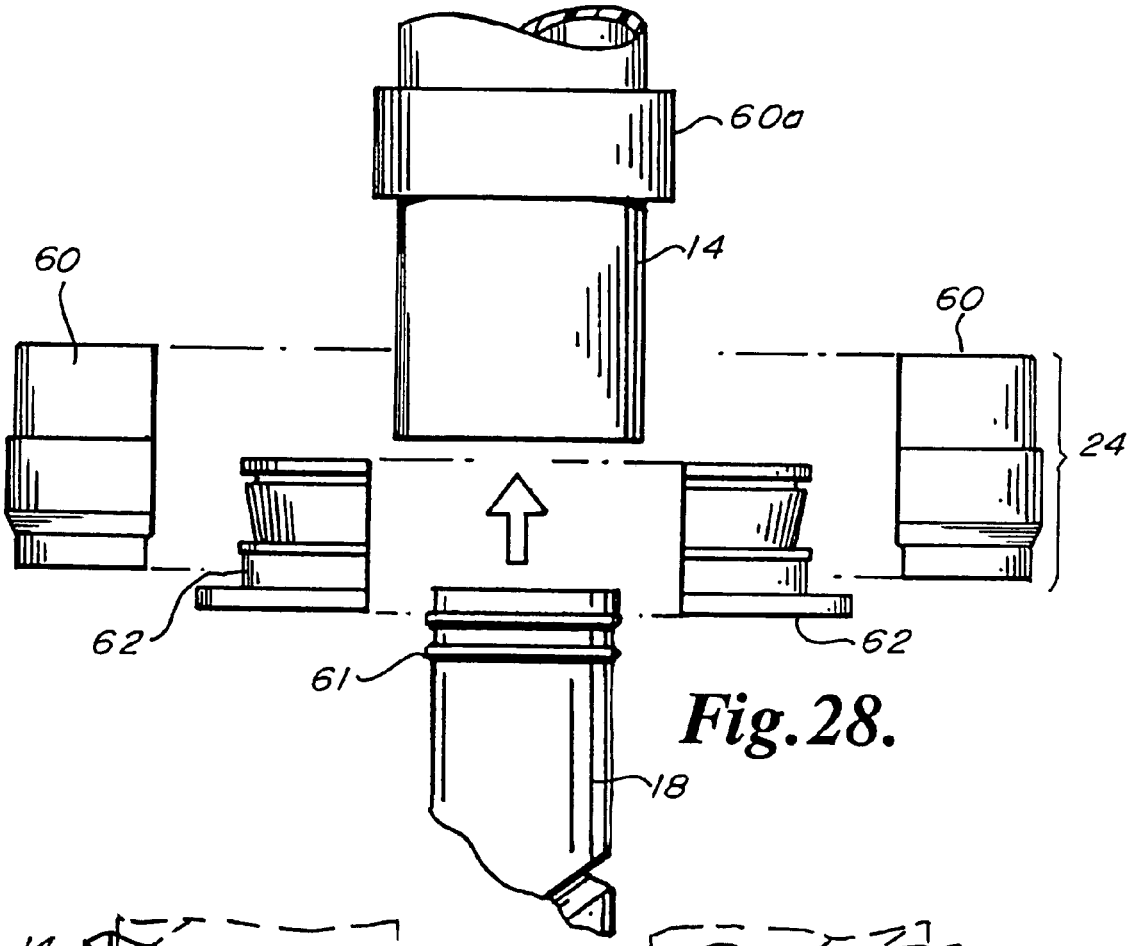
FIG. 28 is an exploded view of a fourth embodiment of the converter of the present invention.
Figure 29:
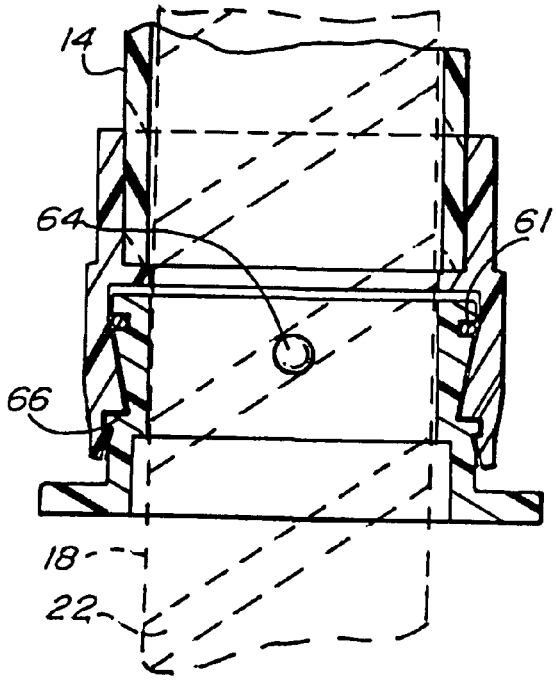
FIG. 29 is a cross-section of the embodiment of FIG. 28, showing the converter in the locked position.
Figure 30:
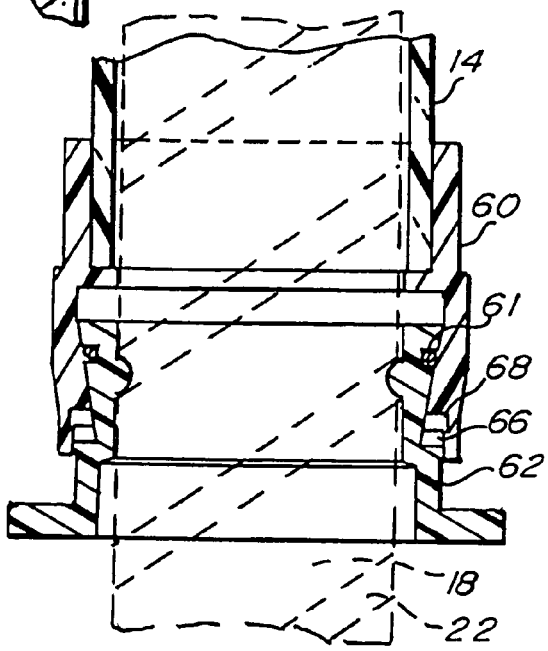
FIG. 30 is similar to FIG. 29, showing the converter in the unlocked position.
Figure 32:
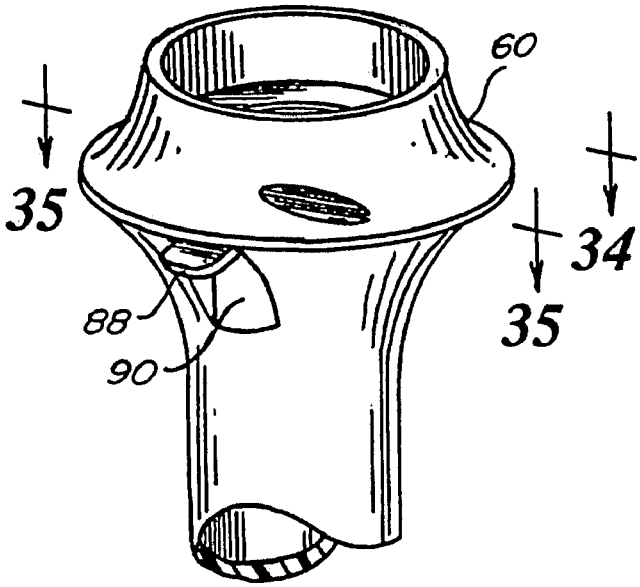
FIG. 32 is similar to FIG. 31, showing the converter in the unlocked position.
Figure 31:
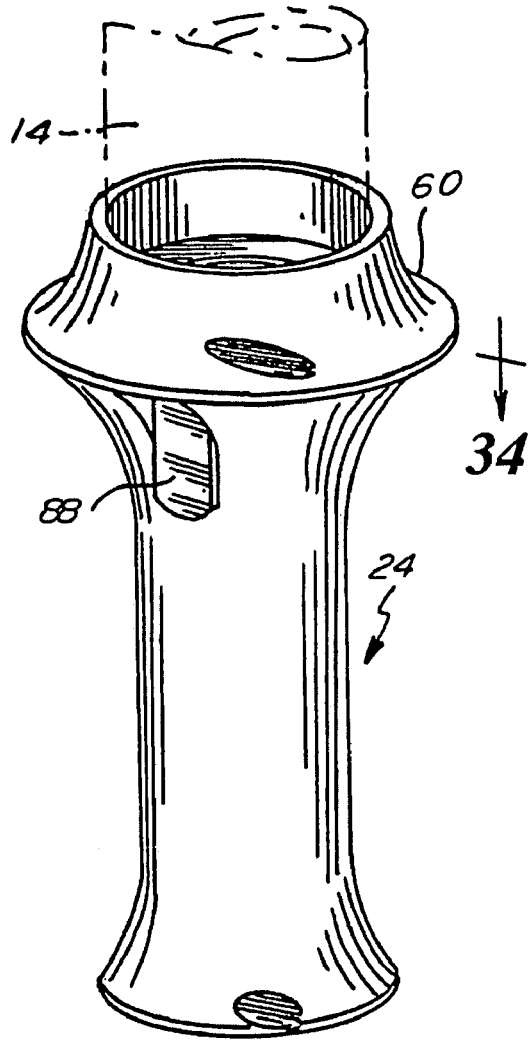
FIG. 31 is a perspective view of a fifth embodiment of the present invention, showing the converter in the locked position.
Figure 33:
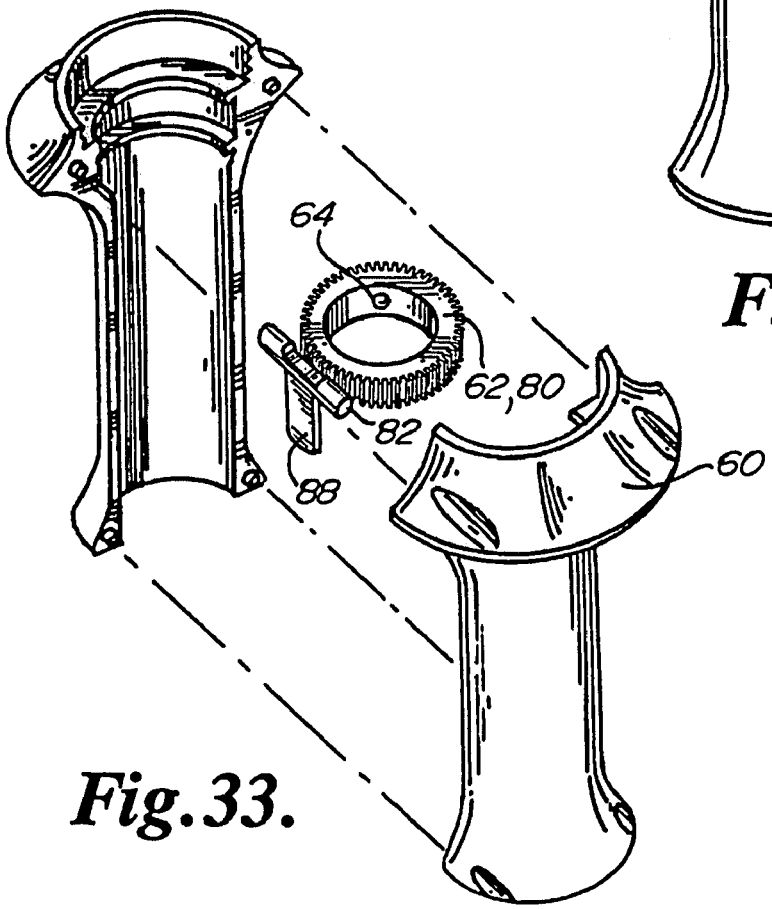
FIG. 33 is an exploded view of the embodiment of FIG. 31.
Figure 34:
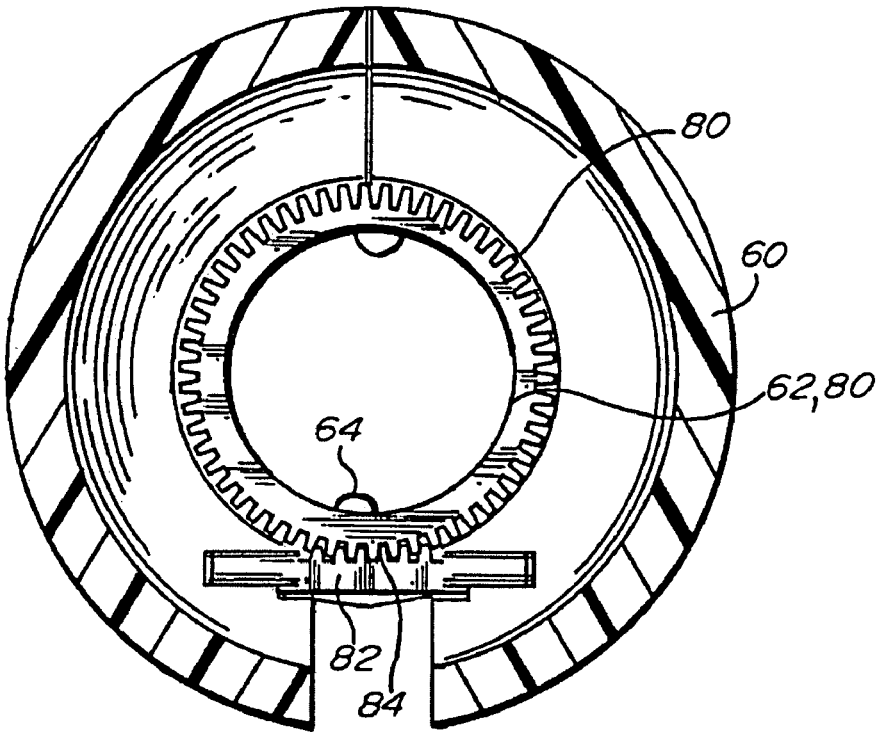
FIG. 34 is a cross-section of FIG. 31.
Figure 35:
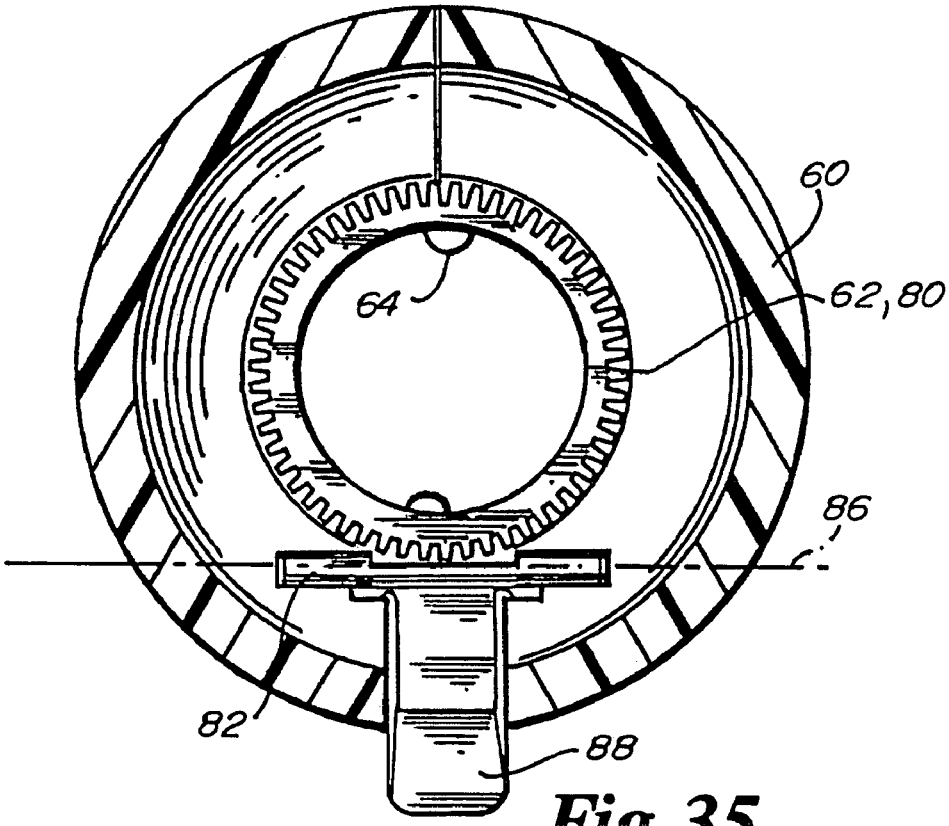
FIG. 35 is a cross-section of FIG. 32.
Figure 37:
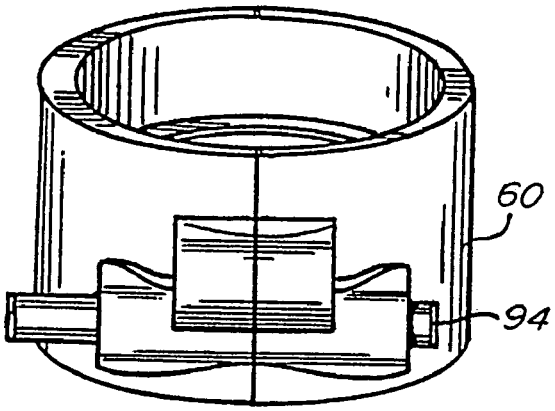
FIG. 37 is similar to FIG. 36, showing the converter in the unlocked position.
Figure 36:
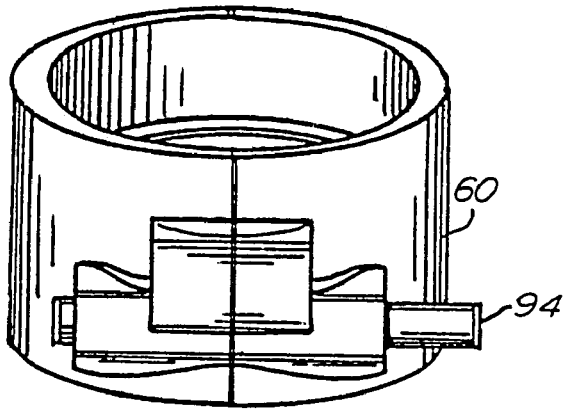
FIG. 36 is a perspective view of a sixth embodiment of the present invention, showing the converter in the locked position.

In a fourth embodiment (FIGS. 28-30), the converter 24 comprises an outer collar 60 and an inner collar 62 rotating therein. The outer collar 60 is fixed to the tube 14 in any suitable manner, such as a friction fit. A locking collar **60*a* may be used to hold the collar 60 against the tube 14. An O-ring 61 may be placed between the outer collar and the inner collar. A raised portion 64 on the inner collar 62 constantly contacts the helical groove 22 in the plunger 18. FIG. 30 shows the converter 24 in an unlocked position in which the inner collar 62 is free to rotate within the outer collar 60, and thus rotation of the plunger 18 has no effect on linear motion of the plunger 18. FIG. 29 shows the converter 24 in a locked position, in which a detent 66 on the inner collar 62 has entered a groove 68 on the outer collar 60, preferably by pushing the inner collar 62 away from the user. In this position, the raised portion 64 contacting the groove 22 effects linear motion of the plunger 18 in the tube 14 when the plunger 18** is rotated.

In a fifth embodiment (FIGS. 31-35), the converter 24 comprises an outer collar 60 and an inner collar 62 rotating therein. The outer collar 60 is fixed to the tube 14 in any suitable manner, such as a friction fit. A raised portion 64 on the inner collar 62 constantly contacts the helical groove 22 in the plunger 18 (see previous drawings and description). The inner collar 62 can be free to rotate within the outer collar 60, thereby allowing the user to move the plunger within the tube, and the inner collar 62 can be locked against rotation within the outer collar, thereby causing rotation of the plunger to be translated into linear motion of the plunger within the tube. In the fifth embodiment, the inner collar 62 further comprises a toothed wheel 80, and the converter 24 further comprises a lock 82 having teeth 84 meshing with the toothed wheel 80 and preventing the toothed wheel 80 from rotating. Preferably, the lock 82 pivots about an axis 86 to alternately engage the teeth 84 with the toothed wheel 80 and to disengage the teeth 84 from the toothed wheel 80. Preferably a lever 88 can be used to pivot the lock 82 about the axis 86, and the lever 88 is accessible through an aperture 90 in the outer collar 60.

Figure 38:
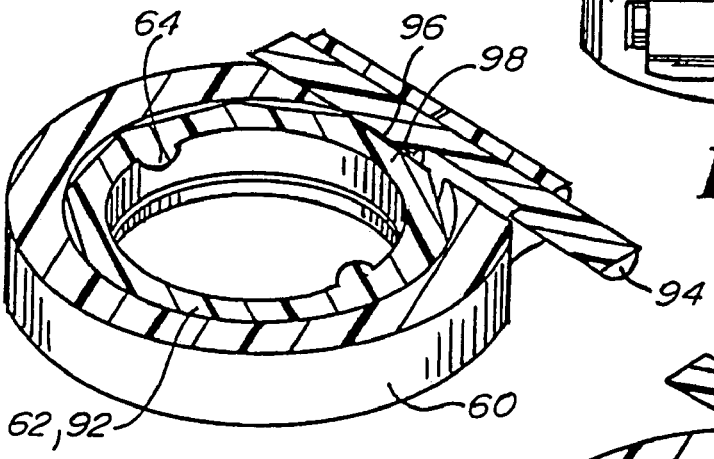
FIG. 38 is a cross-section of the embodiment of FIG. 37.
Figure 39:
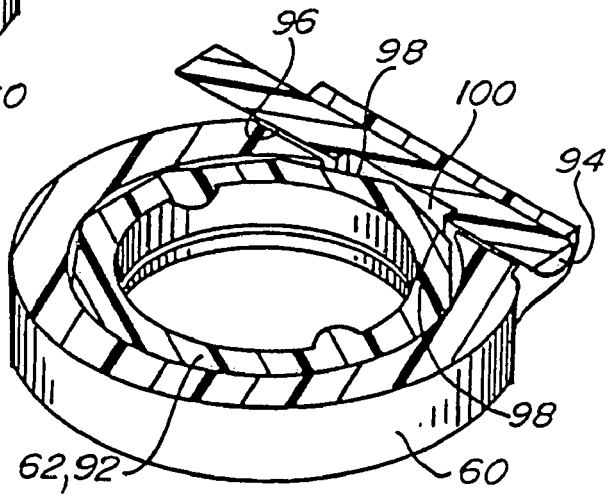
FIG. 39 is a cross-section of FIG. 36.

A sixth embodiment (FIGS. 36-39) is similar to the fifth embodiment except that the inner collar 62, rather than being a toothed wheel, is a polygonal member 92. A lock 94 having a flat surface 96 engages a side 98 of the polygonal member 92 to prevent rotation of the inner collar 62. A cut-out portion 100 permits rotation of the sides 98 of the polygonal member 92. Preferably, the lock 94 slidingly engages the outer collar 60 to move between a first position (FIG. 38) in which the flat surface 96 engages the side 98 and a second position (FIG. 39) in which the flat surface 96 does not engage the side 98 of the polygonal member 92.

To operate the apparatus, the user fills the tube 14 with paint. Preferably, the apparatus has a filler tube 70 that can be inserted into a can of paint, as shown in FIG. 1. The user unlocks the converter 24, and then pulls the plunger 18 out of the tube 14, thus drawing paint into the tube 14. FIG. 18 shows the result. As is well-known, a seal such as an O-;ring 72 on the plunger 18 allows a partial vacuum to be created within the tube 14.

The user may then either leave the converter 24 unlocked, and manually push the plunger 18 into the tube 14, thus dispensing a relatively large amount of paint onto the applicator 12; or the user may lock the converter in any of the embodiments previously described, allowing the user to turn the handle 20 and incrementally dispense small amounts of paint onto the applicator 12.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. Apparatus for painting a surface, comprising:

(a) an absorbent paint applicator containing paint and adapted to contact the surface;

(b) a tube fillable with paint, the tube connected to the applicator; and (c) a metering device for incrementally metering paint onto the applicator from the tube;

(d) wherein the metering device further comprises a plunger reciprocating within the tube, the plunger having a handle, the plunger being incrementally advanced within the tube by rotating the handle, thereby dispensing paint onto the applicator;

(e) further comprising at least one helical groove along the plunger;

(f) wherein the metering device further comprises an outer collar and an inner collar rotating therein, and a raised portion on the inner collar contacting the helical groove;

(g) further comprising a lock engaging the inner collar; and (h) wherein The lock can be moved between a first unlocked position in which the inner collar is free to rotate within the outer collar, thereby allowing the user to move The plunger within the tube, and a second position in which the inner collar is locked against rotation within the outer collar, thereby causing rotation of the plunger to be translated into the linear motion of the plunger within the tube.

2. Apparatus for painting a surface, comprising:

(a) an absorbent paint applicator containing paint and adapted to contact the surface;

(b) a tube fillable with paint, the tube connected to the applicator;

(c) a metering device for metering paint onto the applicator from the tube; and (d) a plunger reciprocating within the tube, the plunger having a handle, the plunger being advanced within the tube, thereby dispensing paint onto the applicator;

(e) wherein the metering device can be set to a first position in which rotation of the plunger is translated into incremental linear motion of the plunger within the tube, and a second position in which the plunger can be freely moved within the tube;

(f) wherein the plunger is helically grooved along its length and wherein the metering device further comprises a converter translating rotation of the handle into linear motion of the plunger, thereby advancing the plunger within the tube; and (g) wherein the converter further comprises an outer collar and an inner collar rotating therein, and a raised portion on the inner collar contacting the helical groove.

3. The apparatus of claim 2, wherein the inner collar can be free to rotate within the outer collar, thereby allowing the user to move the plunger within the tube, and can be locked against rotation within the outer collar, thereby causing rotation of the plunger to be translated into the linear motion of the plunger within the tube.

4. The apparatus of claim 3, wherein the inner collar further comprises a toothed wheel and further comprising a lock having teeth meshing with the toothed wheel and preventing the toothed wheel from rotating.

5. The apparatus of claim 4, wherein the lock pivots about an axis to alternately engage the teeth with the toothed wheel and disengage the teeth from the toothed wheel.

6. The apparatus of claim 5, further comprising a lever pivoting the lock about the axis, the lever being accessible through an aperture in the outer collar.

* * * * *